US005351671A

United States Patent [19]

Cervera

[11] Patent Number: 5,351,671

[45] Date of Patent: Oct. 4, 1994

[54] DISTANCE-COMPENSATING SIGHT FOR AN ARCHERY BOW

[76] Inventor: Albert J. Cervera, Rt. 1, Box 808, Hanover, Va. 23069

[21] Appl. No.: 116,574

[22] Filed: Sep. 7, 1993

[51] Int. Cl.[5] ..... F41G 1/467

[52] U.S. Cl. ..... 124/87; 33/265

[58] Field of Search ..... 124/23.1, 24.1, 25.6, 124/86, 87, 88; 33/265

[56] References Cited

U.S. PATENT DOCUMENTS

| | | | |
|---|---|---|---|
| 2,001,470 | 5/1935 | Nyvall . | |
| 2,788,701 | 4/1957 | Browning . | |
| 3,163,697 | 12/1964 | White . | |
| 3,524,440 | 8/1970 | Hill . | |
| 3,861,051 | 1/1975 | Killian | 33/265 |
| 4,178,693 | 12/1979 | Smith | 33/265 |
| 4,507,874 | 4/1985 | Brown | 33/265 |
| 4,555,856 | 12/1985 | Brown | 33/265 |
| 4,580,349 | 4/1986 | Webb et al. | 33/265 |
| 4,625,421 | 12/1986 | Strauss | 33/265 |
| 4,646,444 | 3/1987 | Cary | 33/265 |
| 4,884,347 | 12/1989 | Larson | 33/265 |
| 4,894,921 | 1/1990 | Barlow | 33/265 |
| 4,915,088 | 4/1990 | Powers | 124/87 |
| 4,979,309 | 12/1990 | Oligschlaeger | 33/265 |
| 5,090,805 | 2/1992 | Stawarz | 356/251 |

*Primary Examiner*—Randolph A. Reese
*Assistant Examiner*—John A. Ricci
*Attorney, Agent, or Firm*—Norman B. Rainer

[57] ABSTRACT

A sight device for mounting upon the handle of an archery bow employs a flat mounting plate and upper and lower facing rectangular mirrors orthogonally attached to the mounting plate. The mirrors are rotatably adjustable in a vertical, plane and constitute a range finder system. An upper aiming pin associated with the lower mirror is manually positionable by the archer in horizontal and vertical directions. A series of horizontal pins adjustably disposed below the lower mirror enable the archer to measure distances beyond the effective range of the mirrors. A series of lower aiming pins enable the archer to aim based upon the dictates of the corresponding distance-measuring pins.

6 Claims, 1 Drawing Sheet

DISTANCE-COMPENSATING SIGHT FOR AN ARCHERY BOW

BACKGROUND OF THE INVENTION

1. Field of the Invention

This invention relates to an archery bow sight, and more particularly concerns an adjustable range finding sight for mounting on an archery bow.

2. Description of the Prior Art

Mastery of the art of archery is extremely difficult as many variables affect the accurate delivery of an arrow to the archer's desired target. The greatest variable is the accurate estimation of the distance the arrow is to travel to the target. An arrow moves relatively slow and falls to earth at an accelerating rate as it approaches the target. The trajectory of the archer's arrows requires extreme accuracy in range estimation in order to effectively place an arrow in a desired target.

The use of a sight pin in conjunction with a peep sight on the string of a bow can provide accuracy if the exact range to the target can be ascertained.

Various bow sights have been disclosed for increasing the archers accuracy. U.S. Pat. No. 2,001,470 issued May 14, 1935 to Nyvall shows a folding bow with a top and bottom mirror acting as a periscope to reflect an image of the target to the eye of the archer. The lower mirror is rotationally articulated to align cross hairs on the lower mirror with the target. The lower mirror must be rotated to pre-arranged positions which relate to various distances which the archer must estimate by other methods.

U.S. Pat. No. 3,163,697 issued Dec. 29, 1964 to White shows a dual spaced mirror device arranged such that the viewer will simultaneously see both a real and a reflected target image. As a viewer looks at the target, a slide is manipulated until the real and reflected images are both seen at the same height. At this position the bow is aimed at the target and is properly positioned such that an arrow will travel the proper trajectory to the target.

U.S. Pat. No. 3,524,440 issued Aug. 18, 1970 to Hill shows a mirror sighting device with an upper and lower mirror with cross hairs on one of the mirrors. The lower mirror is focused on the target while the upper mirror is focused on the lower mirror and reflects the target image to the archers eye. The mirror mounting the cross hairs may be adjusted vertically to compensate for distance to the target.

U.S. Pat. No. 2,788,701 issued Apr. 16, 1957 to Browning, shows a device incorporating multiple mirrors mounted below a single upper mirror for reflecting the image of the target and transmitting the image to the eye at various levels to facilitate trajectory adjustment of the bow for delivery of an arrow to the target.

U.S. Pat. No. 4,507,874 issued Apr. 2, 1985 to Brown, shows a bow sight characterized by a periscope device enclosing a top mirror and a bottom mirror to direct an image of a target to the eye of the archer. A compensating mirror is also mounted in the periscope in parallel adjustment relationship with respect to the top and bottom mirrors. A split target image is viewed in the fixed bottom mirror and comparison of this split image facilitates raising the bow to a proper angle in order to compensate for the trajectory of an arrow.

U.S. Pat. No. 4,555,856, issued Dec. 3, 1985 to Brown, is a continuation-in-part of the earlier '874 patent and shows a bow sight which includes a housing enclosing a bottom mirror, a top mirror mounted in spaced relationship in the housing with respect to the bottom mirror and a narrow compensating mirror positioned in the housing in close proximity to the bottom mirror. The top and bottom mirrors are mounted in substantially parallel relationship at approximately a 45 degree angle in the housing, and a top mirror and the compensating mirror are pivotally mounted with the compensating mirror adjustably responsive to manipulation of a lever from a calibrated position. The target image segment projected from the top mirror to the bottom mirror is compared to the target image segment projected from the compensating mirror to the bottom mirror and the lever is moved in order to provide the necessary adjustment to align the segments and determine the proper trajectory for accurately delivering an arrow to the target.

U.S. Pat. No. 4,979,309 issued Dec. 25, 1990 to Oligschlaeger discloses a bow sight having two mirrors in periscope arrangement, the upper mirror being tiltable in response to an archer-manipulated cam. Tilting of the mirror brings the target into view and simultaneously positions an aiming pin located below the lower mirror.

Numerous drawbacks have existed in the reliability and effective use of prior art sighting devices for archery bows. The need remains in the archery industry for a sight readily adaptable for long bows, recurve bows, compound bows, cross bows, and other similar projectile propelling devices of interest, which can accurately determine the distance between the viewer and the target and which facilitates positioning of a sight pin to the proper trajectory for the arrow to the target. The primary goal of this invention is to fulfill this need.

Another object of the invention is to provide a bow sight which is applicable to various bows and which uses adjustable top and bottom mirrors in cooperation with an adjustable sight pin to determine the distance to the target and compensate for the arrow trajectory.

Yet another object of this invention is to provide an improved range finder device cooperating with a sighting device for various bows, which range finder device is characterized by a frame carrying a bottom mirror and a pivotably adjustable top mirror.

A further object of the present invention is to provide a sight of the aforesaid nature which is automatically on target at distances between about 8 and 30 yards with a slow bow and 50 yards or more with a very fast bow, and has a range finder to cope with greater distances without any moving parts.

A still further object of this invention is to provide a bow sight of the aforesaid nature of simple and rugged design amenable to low cost manufacture.

These and other beneficial objects and advantages will be apparent from the following description.

SUMMARY OF THE INVENTION

The above and other beneficial objects and advantages are accomplished in accordance with the present invention by a sight device comprising:

a) a mounting plate of monolithic construction comprised of a vertical panel elongated between upper and lower extremities, and further bounded by forward and rearward edges, a portion of said panel extending horizontally rearwardly from said rearward edge and having means for attachment to a bow, b) upper and lower mirrors of rectangular shape defined by straight upper, lower, inside and outside margins, said mirrors being orthogonally disposed to said vertical panel, and pivotably attached thereto at the midpoints of said inside margins, said mirrors having flat reflective surfaces of identical size in facing relationship and disposed one above the other in angled disposition to said forward edge whereby the reflective surface of said upper mirror is directed toward said forward edge and the reflective surface of said lower mirror is directed toward said rearward edge, said mirrors being pivotable in a vertical path, c) an upper aiming pin disposed between said lower mirror and said rearward edge, and adjustably positionable by a threaded mechanism in horizontal and vertical directions, d) a series of horizontally disposed straight distance-determining pins supported by said vertical panel below said lower mirror, and e) a series of horizontally disposed lower aiming pins held by said vertical panel below said alignment pins.

BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding part in all the figures of the drawing:

FIG. 3 is a schematic side view illustrating the principles of operation of the bow sight.

DESCRIPTION OF THE PREFERRED

Figure 1:
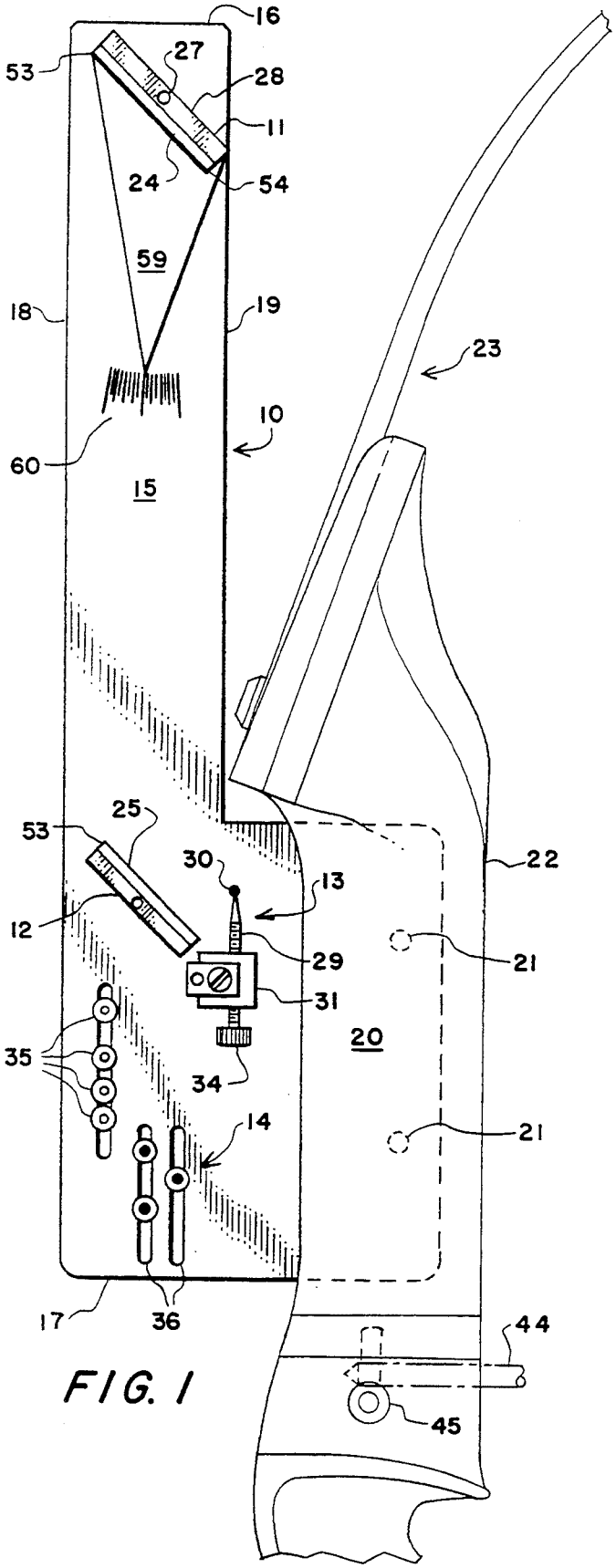
FIG. 1 is a left side elevational view of the bow sight show in operative association with a bow.
Figure 2:
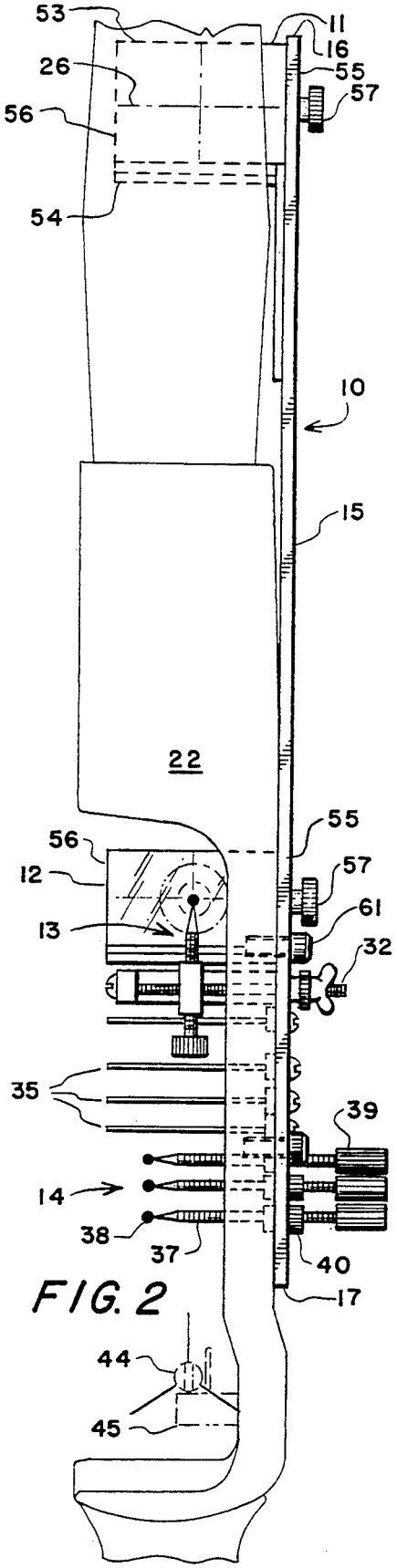
FIG. 2 is a rear elevational view of the bow sight of FIG. 1.

Referring to FIGS. 1–3, an embodiment of the bow sight of the present invention is shown comprised of mounting plate 10 which supports upper and lower mirrors 11 and 12, respectively, upper aiming pin 13, and a series of lower aiming pins 14.

Mounting plate 10 is preferably of integral construction, fabricated of metal or plastic sheet stock. Said mounting plate is comprised of vertical panel 15 elongated between upper and lower extremities 16 and 17, respectively, and further bounded by forward and rearward straight edges 18 and 19, respectively. A horizontal panel portion 20 emergent from rearward edge 19 is provided with holes 21 to facilitate mounting of the bow sight to the handle portion 22 of archery bow 23. Threaded bolts 61 penetrate holes 21 and engage standard threaded sockets in handle portion 22, thereby securing the sight device to the bow. Other means for mounting the bow sight to a bow may, however, be employed, and such mounting means preferably permit adjustability of the position of the bow sight upon the bow.

Said upper and lower mirrors are of rectangular contour, defined by straight upper, lower, inside and outside margins, 53, 54, 55 and 56, respectively, and extend orthogonally from said vertical panel. Both mirrors have flat reflective surfaces 24 and 25 of identical size positioned one above the other in facing relationship. The mirrors are spaced apart about 7" in angled disposition to forward edge 18, whereby the reflective surface 24 of said upper mirror is directed toward said forward edge, and the reflective surface 25 of said lower mirror is directed toward said rearward edge 19. Both mirrors are pivotably secured at the midpoints of their inside margins to plate 10, and are rotatable with frictional restraint in a vertical path about their horizontal midlines 26 upon pivot post 27 perpendicularly secured to vertical panel 15 and disposed upon the rear surface 28 of the mirror. Turning means in the form of knurled knobs 57 facilitate the turning of posts 27. In alternative embodiments, said rotatability may be achieved by means other than a supporting pivot post. For example, the inside margins of the mirror adjacent vertical panel 15 may have mounting tabs that engage arcuate slots in said vertical panel.

Upper aiming pin 13 is comprised of vertical post 29 having a bead 30 at its upper extremity. Post 29 is held by block 31 which is adapted to undergo reciprocal horizontal motion by virtue of threaded engagement with rotatable adjustment post 32. Track means, in the form of slide rod 33 penetrates block 31 and constrains it to accurate horizontal movement. Post 29 is adapted to be vertically moved upon its axis of elongation. Such movement is secured in the exemplified embodiment by virtue of threaded engagement of post 29 with block 31, and the provision of a turning knob 34 located below block 31. The manner of adjustability of aiming pin 13 is such that bead 30 is capable of traversing most of the area of lower reflective surface 25.

A series of horizontally disposed straight distance determining pins 35 is fixedly supported by said vertical panel below lower mirror 12. The length of the pins is comparable to the width of the mirrors.

Horizontally disposed lower aiming pins 14 are frictionally held by vertical slots 36 in vertical panel 15. Each aiming pin 14 is comprised of a shaft portion 37 having a bead 38 at one extremity, and a gripping collar 39 at the opposite extremity. Shaft portion 37 slidably penetrates sleeve 40 which is frictionally secured within slot 36. By virtue of such manner construction, pins 14 can be manipulated by the archer to adjust bead 38 horizontally and vertically.

In use, when the bow is held at full draw in shooting position, upper mirror 11 faces target 42 at a downward angle A with respect to bow axis 50, and the lower mirror faces the archer at an upward angle. Such configuration, as shown in FIG. 3, allows the archer to see the target in the lower mirror and further enables him to position upper aiming pin 13 on the target. The archer is now looking at the target through a deflected line of sight 39 at an angle B with respect to the horizontal distance line 51 drawn to the midline of the lower mirror. Said line of sight is perpendicular to the bow axis and is substantially the line that arrow 44 is initially launched upon. However, due to the specific trajectory of the arrow, which is dependent upon the characteristics of the bow and the arrow, the trajectory path 41 tangentially falls away from the line of sight 39 during its travel to the target 42 at the actual distance 51. The arrangement of the mirrors, and their manner of use cause the bow sight device to function as a range finder. The lower mirror is first adjusted so that the archer can, see the upper mirror totally in the lower mirror when holding the bow in shooting position. Upper mirror 11 is adjusted about pivot post 27 until the angle A between the bow axis and the path of light rays 44 extending from said target to said upper mirror causes the target image to be viewed by the archer at the proper angle B such that the path of the arrow corresponds to the actual distance 51. A pointer 59 attached to upper mirror 24, and interactive scale of markings 60 on plate 10 permit accurate resetting setting of the mirror.

If the target is above first pin 35 in the true line of sight, the target is in range of the mirror's sight. When the target is below the first pin 35, the mirrors become part of a range finding system. To use the range finder, the archer looks at the target in the lower mirror and places the aiming pin on the target. Then, without moving, he looks at the target to see which of the lower pins 35 lines up with the target. This tells the archer how far the target is. Then, by using a pin 14 preset set for the distance, the archer can now shoot accurately at the target. Such aiming can be done in a second or two.

The setting of pins 14 and 35 is done after the sight is mounted upon the bow and shooting accurately. Then the pins are set as to the exact shooting characteristics of the bow and arrow combination.

The bow sight device is mounted upon the bow in a manner such that arrow rest 45 of said bow is about 3" below said lower mirror, and the arrow is substantially centered on the vertical mid-line 48 of said mirrors.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A sight device for mounting upon the handle of an archery bow comprising:

a) a mounting plate comprised of a vertical panel elongated between upper and lower extremities, and further bounded by forward and rearward edges, a portion of said panel extending horizontally rearwardly from said rearward edge and having means for attachment to a bow, b) upper and lower mirrors of rectangular shape defined by straight upper, lower, inside and outside margins, said mirrors being orthogonally disposed to said vertical panel, and pivotably attached thereto at the midpoints of said inside margins, said mirrors having flat reflective surfaces of identical size in facing relationship and disposed one above the other in angled disposition to said forward edge whereby the reflective surface of said upper mirror is directed toward said forward edge and the reflective surface of said lower mirror is directed toward said rearward edge, said mirrors being pivotable in a vertical path, c) an upper aiming pin disposed between said lower mirror and said rearward edge, and adjustably positionable by a threaded mechanism in horizontal and vertical directions, d) a series of horizontally disposed straight distance-determining pins supported by said vertical panel below said lower mirror, and e) series of horizontally disposed lower aiming pins held by said vertical panel below said distance-determining pins.

2. The sight device of claim 1 wherein said means for attachment to a bow are two vertically spaced holes.

3. The sight device of claim 1 wherein said mirrors are spaced apart by about six to eight inches.

4. The sight device of claim 1 wherein said distance-determining pins and aiming pins are frictionally held by vertical slots in said handle.

5. The sight device of claim 4 wherein said distance-determining pins and aiming pins are adjustably positionable in horizontal and vertical directions.

6. The sight device of claim 1 wherein a pointer and angle-measuring scale of markings are associated with said upper mirror.

* * * * *